US009972341B2

(12) United States Patent
Lee

(10) Patent No.: US 9,972,341 B2
(45) Date of Patent: May 15, 2018

(54) APPARATUS AND METHOD FOR EMOTION RECOGNITION

(71) Applicant: Samsung Electronics Co., Ltd., Suwon-si (KR)

(72) Inventor: Ye Ha Lee, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 145 days.

(21) Appl. No.: 14/518,874

(22) Filed: Oct. 20, 2014

(65) Prior Publication Data

US 2015/0206543 A1 Jul. 23, 2015

(30) Foreign Application Priority Data

Jan. 22, 2014 (KR) ..... 10-2014-0007883

(51) Int. Cl.
*G10L 11/00* (2006.01)
*G10L 25/63* (2013.01)

(52) U.S. Cl.
CPC ..... *G10L 25/63* (2013.01)

(58) Field of Classification Search
CPC ..... G10L 17/26; G10L 13/00; G10L 25/63; G06F 2203/011
USPC ..... 704/270, 235, 251, 256
See application file for complete search history.

(56) References Cited

U.S. PATENT DOCUMENTS 6,151,571 A * 11/2000 Pertrushin ..... G10L 17/26 704/207
8,204,747 B2 6/2012 Kato et al.
8,386,257 B2 2/2013 Irie et al.
2003/0055654 A1* 3/2003 Oudeyer ..... G10L 17/26 704/275
2006/0122834 A1* 6/2006 Bennett ..... G10L 15/1822 704/256
2008/0052080 A1* 2/2008 Narayanan ..... G06F 17/2785 704/270
2009/0265170 A1 10/2009 Irie et al.
2010/0145695 A1* 6/2010 Jung ..... G10L 17/26 704/246

(Continued)

FOREIGN PATENT DOCUMENTS

JP 4580190 B2 9/2010
JP 5039045 B2 7/2012

(Continued)

OTHER PUBLICATIONS

Kwon, Chulong, et al. "Extraction of Speech Features for Emotion Recognition." Journal of the Korean Society of Speech Sciences, vol. 4, Issue 2, (2012) pp. 73-78.

*Primary Examiner* — Jakieda Jackson
(74) *Attorney, Agent, or Firm* — NSIP Law

(57) ABSTRACT

An apparatus and a method for emotion recognition are provided. The apparatus for emotion recognition includes a frame parameter generator configured to detect a plurality of unit frames from an input speech and to generate a parameter vector for each of the unit frames, a key-frame selector configured to select a unit frame as a key frame among the plurality of unit frames, an emotion-probability calculator configured to calculate an emotion probability of each of the selected key frames, and an emotion determiner configured to determine an emotion of a speaker based on the calculated emotion probabilities.

18 Claims, 10 Drawing Sheets

(56) References Cited

U.S. PATENT DOCUMENTS

| | | | | |
|---|---|---|---|---|
| 2011/0295607 | A1* | 12/2011 | Krishnan | G10L 17/26<br>704/270 |
| 2011/0307257 | A1* | 12/2011 | Pereg | G06Q 10/063<br>704/251 |
| 2014/0236596 | A1* | 8/2014 | Martinez | G06F 17/2785<br>704/235 |
| 2014/0257820 | A1* | 9/2014 | Laperdon | G10L 25/63<br>704/270 |

FOREIGN PATENT DOCUMENTS

| | | | |
|---|---|---|---|
| KR | 10-2010-0094182 | A | 8/2010 |
| KR | 10-2011-0017559 | A | 2/2011 |
| KR | 10-1029786 | B1 | 4/2011 |

* cited by examiner

APPARATUS AND METHOD FOR EMOTION RECOGNITION

CROSS-REFERENCE TO RELATED APPLICATION(S)

This application claims the benefit under 35 USC 119(a) of Korean Patent Application No. 10-2014-0007883 filed on Jan. 22, 2014, in the Korean Intellectual Property Office, the entire disclosure of which is incorporated herein by reference for all purposes.

BACKGROUND

1. Field

The following description relates to speech emotion recognition, and to an apparatus and a method for emotion recognition from speech that involve analyzing changes in voice data, detecting frames that contain relevant information, and recognizing emotions using the detected frames.

2. Description of Related Art

Emotion recognition improves accuracy of personalized services, and plays an important role for the development of a user-friendly device. Research on emotion recognition is being conducted with a focus on facial expressions, speech, postures, biometric signals, and the like. A frame-based speech emotion recognition technology has been developed, which analyzes changes in voice data and detects frames that contain information. The speech emotion recognition technology targets the speaker's entire speech data. However, an emotion of the speaker is generally exhibited only momentarily during a speech, and not constantly throughout the entire time duration of a speech. Thus, for speech data collected for most purposes, the emotion of the speaker as indicated by his or her voice is neutral and unrelated to an emotion for a large proportion of the speech duration. Such neutral voice data is irrelevant to the emotion recognition apparatus or method, and may be considered as mere neutral noise information that hinders with the emotion recognition of the speaker. Due to the presence of the neutral voice data, the existing speech emotion recognition apparatuses and methods have difficulties in accurately detecting the exact emotion of a speaker that appears only momentarily during the entire speech.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an apparatus for emotion recognition includes a frame parameter generator configured to detect a plurality of unit frames from an input speech and to generate a parameter vector for each of the unit frames, a key-frame selector configured to select a unit frame as a key frame among the plurality of unit frames, an emotion-probability calculator configured to calculate an emotion probability of each of the selected key frames, and an emotion determiner configured to determine an emotion of a speaker based on the calculated emotion probabilities.

The general aspect of the apparatus may further include an inputter configured to obtain the input speech from a microphone or from a memory storing voice data.

The key-frame selector may be configured to select the key frame according to probability of occurrence within the plurality of unit frames.

The key-frame selector may be configured to select a unit frame with a higher probability of occurrence than a predetermined fraction of the plurality of unit frames as the key frame.

The key-frame selector may be configured to select the key frame according to probability of presence within a plurality of previously stored reference frames.

The key-frame selector may be configured to select a unit frame with a higher probability of presence than a predetermined fraction of the plurality of unit frames as the key frame.

The key-frame selector may be configured to include an occurrence probability calculator configured to calculate a probability of each unit frame occurring within the plurality of unit frames, a presence probability calculator configured to calculate a probability of each unit frame being present within a plurality of previously stored reference frames, a frame relevance estimator configured to assign a first relevance value to each unit frame with a higher probability of occurrence, assign a second relevance value to the each unit frame with a lower probability of occurrence, wherein the first relevance value indicates a higher probability of being selected as a key frame, and the second relevance value indicates a lower probability of being selected as a key frame, and to estimate relevance of each unit frame by taking into consideration both the first relevance value and the second relevance value, and a key-frame determiner configured to determine the unit frame as being the key frame according to the assigned relevance value.

The emotion-probability calculator may be configured to calculate the emotion probability by extracting a global feature from the selected key frame and classifying an emotion of the speaker into at least one of predefined emotion categories using a support vector machine (SVM) mechanism and the global feature.

The emotion-probability calculator may be configured to calculate the emotion probability by classifying an emotion of the speaker into at least one emotion category that corresponds to a generative model that is capable of generating a largest number of parameter vectors same as or similar to those of the key frames, wherein the generative model is one of Gaussian Mixture Model (GMM) and Hidden Markov Model (HMM), which are obtained from learning each emotion category.

The emotion-probability calculator may be configured to further calculate an emotion probability of each of the unit frames, and the emotion determiner may be configured to determine an emotion of the speaker using both the emotion probabilities of the key frames and the calculated emotion probabilities of the unit frames.

The emotion probability of each of the key frames and the emotion probability of each of the unit frames may be calculated by extracting a global feature from the key frames and classifying an emotion of the speaker into at least one of predefined emotion categories using an SVM and the extracted global feature, or by classifying an emotion of the speaker into at least one emotion category that corresponds to a generative model that is capable of generating a largest number of parameter vectors same as or similar to those of the key frames. The generative model may be one of Gaussian Mixture Model (GMM) and Hidden Markov Model (HMM), which are obtained from learning each emotion category.

In another general aspect, a method for emotion recognition may involve detecting a plurality of unit frames from an input speech and generating a parameter vector for each of the unit frames, selecting a unit frame as a key frame among the plurality of unit frames, calculating an emotion probability for each of the selected key frames, and using a processor to determine an emotion of a speaker based on the calculated emotion probabilities.

The general aspect of the method may further involve obtaining the input speech via a microphone or from a memory storing a voice data.

The selecting of the key frame may involve selecting the key frame according to probability of occurrence within the plurality of unit frames.

The selecting of the key frame may involve selecting a unit frame with a higher probability of occurrence than a predetermined fraction of the plurality of unit frames as the key frame.

The selecting of the key frame may involve selecting the key frame according to probability of presence within a plurality of previously stored reference frames.

The selecting of the key frame may involve selecting a unit frame with a higher probability of presence than a predetermined fraction of the plurality of unit frames as the key frame.

The selecting of the key frame may involve calculating a probability of each unit frame occurring within the plurality of unit frames, calculating a probability of each unit frame present within a plurality of previously stored reference frames, and assigning a first relevance value to each unit frame with a higher probability of occurrence, assigning a second relevance value to the each unit frame with a lower probability of occurrence. The first relevance value may indicate a higher probability of being selected as a key frame, and the second relevance value may indicate a lower probability of being selected as a key frame. The selecting may further involve estimating relevance of each unit frame by taking into consideration both the first relevance value and the second relevance value, and determining the unit frame as the key frame according to the assigned relevance value.

The calculating of the emotion probability may include extracting a global feature from the selected key frames and classifying an emotion of the speaker into at least one of predefined emotion categories using a support vector machine (SVM) mechanism and the global feature.

The calculating of the emotion probability may involve classifying an emotion of the speaker into at least one emotion category that corresponds to a generative model that is capable of generating a largest number of parameter vectors same as or similar to those of the key frames. The generative model may be one of Gaussian Mixture Model (GMM) and Hidden Markov Model (HMM), which are obtained from learning each emotion category.

The calculating of the emotion probability may involve further calculating an emotion probability of each of the unit frames, and determining an emotion of the speaker using both the emotion probabilities of the key frames and the calculated emotion probabilities of the unit frames.

The calculating of the emotion probability may involve: extracting a global feature from the key frames and classifying an emotion of the speaker into at least one of predefined emotion categories using an SVM and the extracted global feature; or classifying an emotion of the speaker into at least one emotion category that corresponds to a generative model that is capable of generating a largest number of parameter vectors same as or similar to those of the key frames, wherein the generative model is one of Gaussian Mixture Model (GMM) and Hidden Markov Model (HMM), which are obtained from learning each emotion category.

In another general aspect, an apparatus for emotion recognition includes a microphone configured to detect an input speech, and a processor configured to divide the input speech into a plurality of unit frames, to select a unit frame as a key frame among the plurality of unit frames based on relevance of each of the unit frames for emotion recognition, to calculate an emotion probability of each of the selected key frames, and to determine an emotion of the speaker based on the calculated emotion probabilities.

The processor may be configured to select a unit frame with a higher probability of occurrence than a predetermined fraction of the plurality of unit frames as the key frame.

Other features and aspects will be apparent from the following detailed description, the drawings, and the claims.

Figure 1:
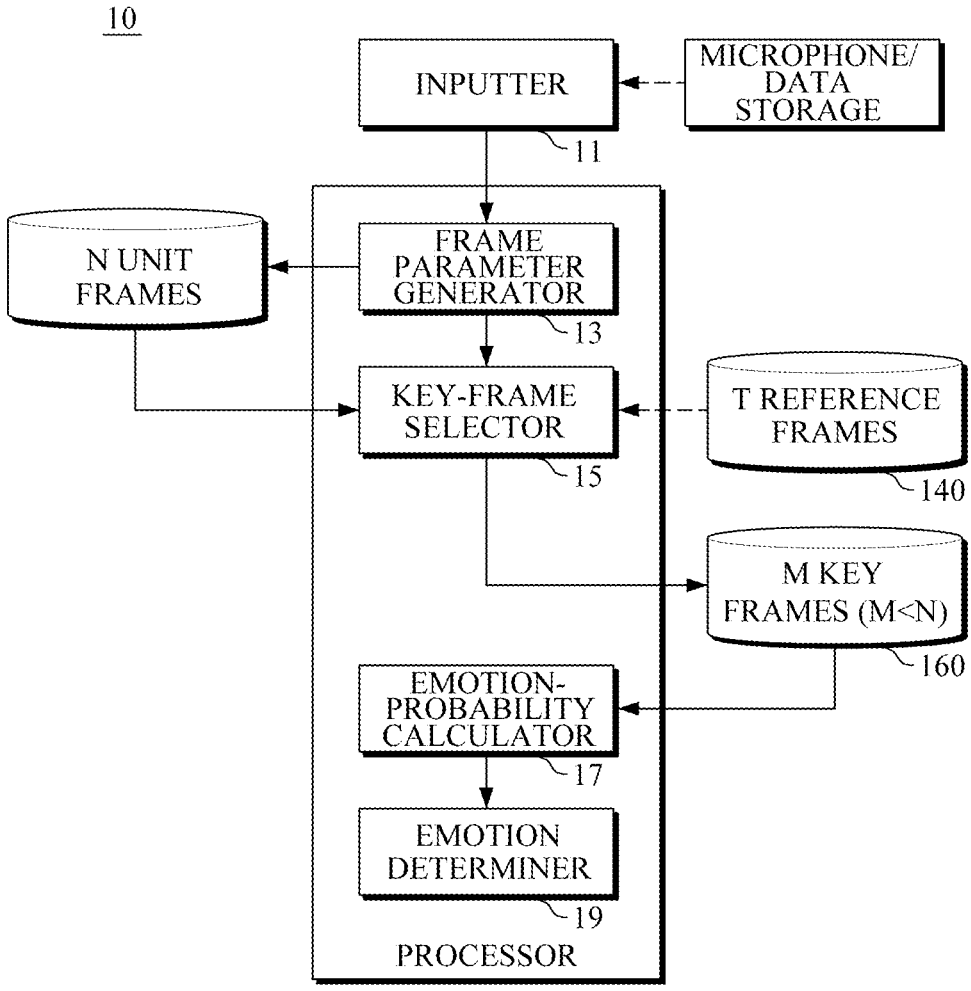
FIG. 1 is a block diagram illustrating an example of an apparatus for emotion recognition.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

A change in the emotion of a speaker, such as "happy", "angry", "sad", "joy", "fearsome" and the like, may be accompanied by a substantial change in features of voice data such as speech pitch, speech energy, speech speed or the like. Thus, emotion recognition of a speaker of a speech may be accomplished by analyzing a speech obtained from a speaker.

In a frame-based speech emotion recognition method, a change in a speech of a speaker, or voice data, is analyzed to detect frames that contain information about the changes. A frame refers to a voice data unit based on an interval with a predetermined time length. For example, n frames may be detected from a speech of a user, and each frame may have a length of 20 ms to 30 ms. The frames may overlap with each other in time.

Then, a parameter vector may be extracted from each of n intervals, i.e., n frames. Here, n is a positive integer. Herein, variables n, t, and m, which indicate the number of frames, are all positive integers. The parameter vector indicates meaningful information carried by each frame, and may include, for example, spectrum, Mel-Scale Frequency Cepstral Coefficients (MFCCs), formant, and the like. From the n frames, n parameter vectors can be extracted.

There are generally two techniques of recognizing an emotion from a speech of a user using the frames or parameter vectors.

One technique is to generate new global features from the n parameter vectors. The global features may include, for example, an average, a maximum value, a minimum value, and other features. The generated global features are used by a sorter, such as a support vector machine (SVM), to determine an emotion in the speech of a user.

Another technique is to use generative models, such as a Gaussian mixture model (GMM) or a hidden Markov model (HMM), which are built by learning each of emotion categories. Examples of emotion categories include "happy", "angry", "sad", "joy", "fearsome" and the like. Each generative model is obtained from learning each particular emotion category. Each of the generative models corresponds to each of the emotion categories and generates parameter vectors different from each other. Therefore, it is possible to compare the n parameter vectors extracted from the speech of a user and the parameter vectors generated from the generative models. Based on the comparison result, a generative model that has parameter vectors that are the same or similar to the n parameter vectors from the speech of a user can be identified. Then, it may be determined that an emotion category corresponding to the identified generative model is an emotional state of the user's speech.

The existing speech emotion recognition encounters difficulties in accurately recognizing momentary emotion in a speech of a user. The typical speech emotion recognition targets the entire user speech data. Because an emotion is generally shown momentarily, and not all the time during speech, most part of the user speech data can be neutral, which is not related to any emotional state. Such neutral data is irrelevant to the emotion recognition, and may be considered noise information useless for and even interruptive for the emotion recognition. Hence, if it is possible to remove neutral noise information from the user's speech and precisely detect relevant parts that are related to an emotion, emotion recognition performance can be improved.

The speech emotion recognition apparatus and method may provide a technique to recognize an emotion using a small number of key frames selected from the speech of a user.

A "key frame" refers to a frame selected from n frames that constitute the speech of a user. The n frames may include neutral noise information that is not related to an emotion in the speech of a user. Thus, selecting key frames from the speech of a user may indicate removal of neutral noise information.

The speech emotion recognition apparatus and method may also provide a technique for recognizing an emotion in speech of a user using a small number of key frames selected according to the relevance linked to probabilities of occurrence within the speech of a user.

Additionally, the speech emotion recognition apparatus and method may provide a technique for recognizing an emotion in speech of a user using a small number of key frames selected according to the relevance linked to probabilities of presence within reference data that include a plurality of previously stored frames.

Moreover, the speech emotion recognition apparatus and method may provide a technique for recognizing an emotion in speech of a user using a small number of key frames selected according to relevance for emotion recognition that takes into account both probability of occurrence within the speech of a user and probability of presence within reference data including a plurality of previously stored frames.

Furthermore, the speech emotion recognition apparatus and method may provide a technique for recognizing an emotion in a speech of a user by using not only a small number of key frames selected from the speech of a user, but also all frames of the speech of a user.

FIG. 1 is a block diagram illustrating an example of an apparatus for emotion recognition from speech.

Referring to FIG. 1, there is provided a speech emotion recognition apparatus 10 that recognizes an emotion of a speaker by eliminating the emotionally neutral segments of a speech, or the neutral noise information of a speech, from data corresponding to the speaker's entire speech.

The speech emotion recognition apparatus 10 may include components, such as, an inputter 11, a frame parameter generator 13, a key-frame selector 15, an emotion-probability calculator 17, an emotion determiner 19, and the like. According to one example, the frame parameter generator 13, the key-frame selector 15, the emotion-probability calculator 17, the emotion determiner 19 are implemented as one or more computer processors.

In this example, the inputter 11 is a component that receives a block of speech, which will be referred to as an "input speech." Here, the "input speech" refers to voice data from which the emotion of a speaker is detected and recognized by the use of the speech emotion recognition apparatus and/or method. The input speech may be received through a microphone in real time, or obtained as voice data that has been previously stored in a computer-readable storage medium. According to one example, the inputter 11 includes a microphone that detects the speech. The speech is then converted to voice data and stored in a memory of the apparatus 10 for further processing. According to another example, the inputter 11 obtains voice data that corresponds to an input speech from an external computer-readable storage medium.

The frame parameter generator 13 may detect a plurality of unit frames from the input speech. The unit frame refers to meaningful section voice data of a specific time length within the input speech. For example, in the event that an input speech with a length of 3 seconds is received, approximately 300 to 500 unit frames, each of which has a length of 20 ms to 30 ms, may be detected from the input speech. When detecting unit frames, different unit frames may overlap within the same time period.

In addition, the frame parameter generator 13 may create a parameter vector from each detected unit frame. Here, "parameter vector" may include parameters that indicate voice properties, for example, spectrum, MFCC, formant, etc. from among information contained in the individual unit frames.

The unit frames and parameter vectors created by the frame parameter generator 13 may be stored as speech data 120 in a storage medium, such as memory. The speech data 120 may include, for example, data regarding n unit frames detected from the input speech, which will be described below with reference to FIG. 2.

Figure 2:
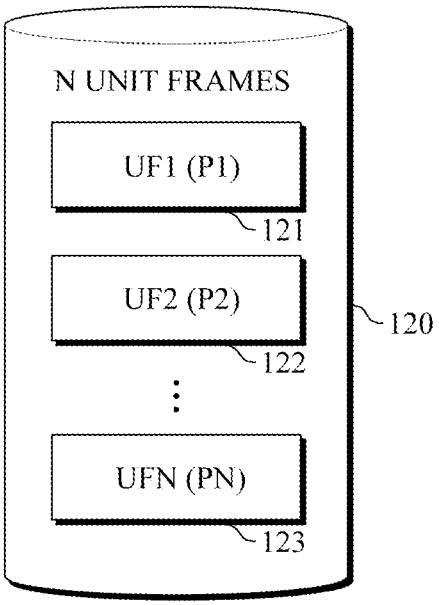
FIG. 2 is a block diagram of speech data generated by dividing an input speech into n unit frames and extracting parameter vectors from the unit frames, in accordance with the example of apparatus for emotion recognition illustrated in FIG. 1.

FIG. 2 is a block diagram of speech data that is created by separating input speech into n unit frames and extracting parameter vectors from the unit frames in the apparatus of FIG. 1.

Referring to FIG. 2, the speech data 120 may include n unit frames including UF1 121, UF2 122, . . . , and UFN 123, and n parameter vectors P1, P2, . . . , and PN corresponding to the respective n unit frames.

Referring back to FIG. 1, the key-frame selector 15 is a component to select some unit frames as key frames and generate key-frame data 160.

Each key frame is one of n unit frames contained in the speech data 120. The key-frame data 160 generated by the key-frame selector 15 is a subset of the speech data 120 generated by the frame parameter generator 13. Thus, the key-frame data 160 differs from the speech data 120 only in that it has fewer frames, and contains data similar to those contained in the speech data 120.

The key-frame selector 15 may select a unit frame as a key frame according to predetermined criteria with respect to properties associated with unit frames. For example, when one of parameters of a parameter vector extracted from a unit frame satisfies a predetermined criterion, the unit frame can be selected as a key frame.

Alternatively, the key-frame selector 15 calculates a probability of a specific unit frame occurring during the speaker's speech, and when this probability satisfies a predetermined criterion, determines the unit frame as a key frame.

For example, the input speech may be represented as speech data 120 consisting of n unit frames, as illustrated in FIG. 2. In this example, a parameter vector, such as spectrum, MFCC, or formant, is extracted from each individual unit frame. Some unit frames may have the same parameter vector or parameter vectors that are similar to a certain extent. The multiple unit frames having the same parameter vector or similar parameter vectors may be regarded as the same unit frames. The number of particular same unit frames within the n unit frames may be represented as a probability of occurrence.

For example, under the assumption that a particular unit frame among 300 unit frames occurs 10 times, the probability of occurrence of the particular unit frame is supposedly "10/300." Such probability of occurrence of each unit frame may be used to determine the unit frame's relevance for emotion recognition. For example, a unit frame that has a higher probability of occurrence in the input speech may be considered to contain more relevant data. Thus, the relevance of a unit frame with a higher probability of occurrence can be determined as having a higher value. On the contrary, the relevance of a unit frame with a lower probability of occurrence may be determined as having a lower value. Among all unit frames having their relevance value set in this manner, only the unit frames whose relevance values are, for example, top 10% may be determined as key frames.

Further, the key-frame selector 15 may calculate a probability of presence of a unit frame in reference data 140, and when the obtained probability satisfies a predetermined criterion, determine the unit frame as being key frame.

The reference data 140 is collected in advance and stored in memory. The reference data 140 may include frames of voice data that has been previously used for speech emotion analysis, namely, t reference frames. Here, t may denote a value that is much greater than n. For example, if n denotes several hundred, t may denote several million or several thousand. The reference data is collected based on the previous input speech, and is thus presumed to contain quite a lot of neutral noise information that is irrelevant to the emotion of the speaker. The reference data 140 may include t reference frames and t parameter vectors corresponding to the reference frames, which will be described in detail below with reference to FIG. 3.

Figure 3:
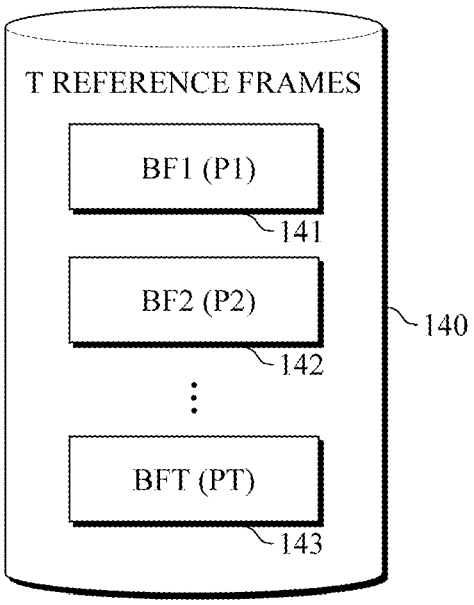
FIG. 3 is a diagram illustrating an example of reference data, including t reference frames and parameter vectors that may be stored in an apparatus for emotion recognition prior to obtaining an input speech.

FIG. 3 is a diagram illustrating an example of reference data including t reference frames and parameter vectors, which is previously stored in the apparatus of FIG. 1.

Referring to FIG. 3, the reference data 140 may include t reference frames BF1 141, BF2 142, . . . , and BFT 143, and t parameter vectors P1, P2, . . . , and PT corresponding to the reference frames.

Referring back to FIG. 1, n unit frames within the speech data 120 and the t reference frames within the reference data 140 both have parameter vectors, such as spectrum MFCC, or formant, so that they can be compared to each other with respect to their parameter vectors. Thus, there may be a plurality of reference frames that have the same parameter vector or parameter vectors that are similar to a certain extent to those of the unit frames. The number of reference frames that have the same or similar parameter vectors to that of a particular reference frame may be represented as a probability of presence in the t reference frames.

For example, among one million reference frames, there may be ten thousand reference frames having the same or similar parameter vector to that of a particular unit frame. In this example, a probability of presence of the particular unit frame may be "10000/1000000." The probability of presence may be used to determine the relevance of each frame for emotion recognition. For example, a unit frame with a higher probability of presence is more likely to be neutral noise information or emotionally neural information, and can thus be presumed to not include information relevant to determining the emotion of the speaker. Accordingly, the relevance of a frame with a higher probability of presence may be set to a lower value. On the contrary, the relevance of a frame with a lower probability of presence may be set to a higher value. Among all unit frames having their relevance values set in this manner, only the unit frames whose relevance values are, for example, the bottom 10% may be determined to be key frames.

Furthermore, the key-frame selector 15 may select the key frames according to the relevance of each unit frame that takes into consideration both the probability of occurrence in the input speech and the probability of presence within reference data. This will be described in detail with reference to FIG. 4.

Figure 4:
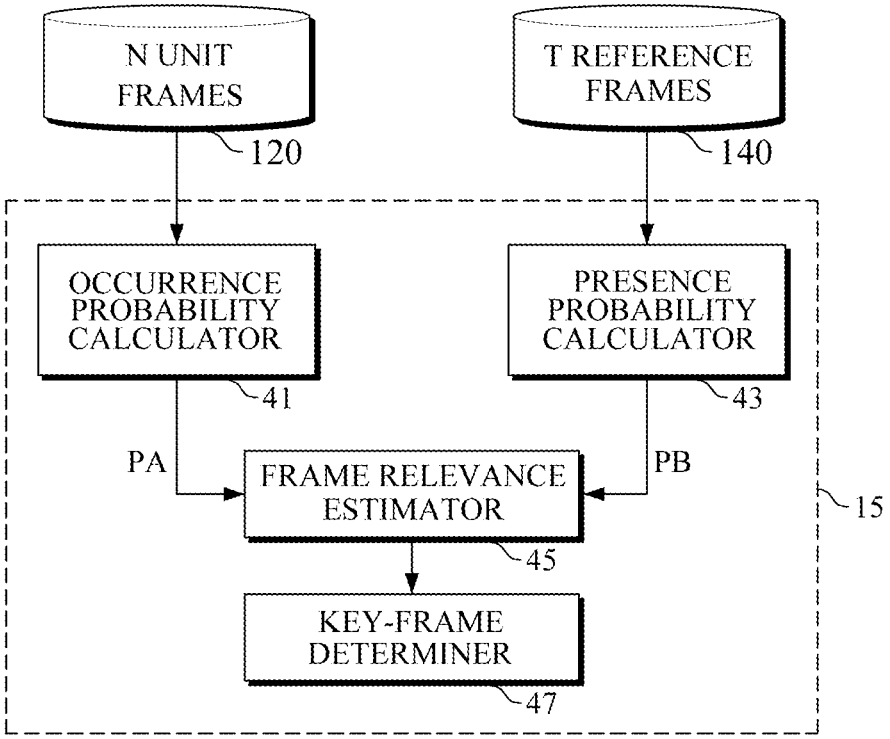
FIG. 4 is a block diagram illustrating an example of a key-frame selector in accordance with the example illustrated in FIG. 1.

FIG. 4 is a block diagram illustrating in detail an example of the key-frame selector of FIG. 1.

Referring to FIG. 4, the key-frame selector 15 may include a number of components including an occurrence probability calculator 41, a presence probability calculator 43, a frame relevance estimator 45, and a key-frame determiner 47.

The occurrence probability calculator 41 calculates a probability of each unit frame occurring in the speech data 120, that is, the probability PA of occurrence (herein, it will be referred to as an "occurrence probability PA") within n unit frames. The presence probability calculator 43 calculates a probability of each unit frame being present in the reference data 140, that is, a probability (PB) of presence (herein, it will be referred to as a "presence probability PB") within t reference frames.

Here, the occurrence probability (PA) of a particular unit frame may indicate the number of unit frames among the n unit frames that have the same or similar parameter vector to that of the particular unit frame. In addition, the presence probability (PB) of a particular unit frame may indicate the number of reference frames among the t reference frames that have the same or similar parameter vector to that of the particular unit frame.

The frame relevance estimator 45 takes into account both the PA and the PB when estimating the relevance of the particular unit frame for emotion recognition. The relationship among PA and PB, and the relevance value S, will be described in detail with reference to FIGS. 5 and 6.

Figure 5:
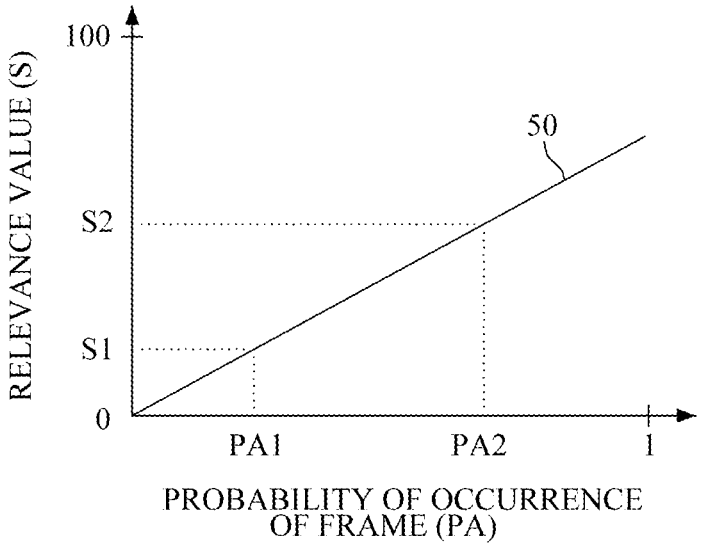
FIG. 5 is a graph illustrating a method of determining relevance of the particular unit frame for emotion recognition according to its probability of occurrence within speech data in the example illustrated in FIG. 4.

FIG. 5 is a graph showing a method of determining relative importance of a particular unit frame for emotion recognition according to its probability of occurrence within speech data in the example illustrated in FIG. 4.

Referring to FIG. 5, a horizontal axis of the graph corresponds to the occurrence probability (PA) ranging from 0 to 1 and a vertical axis of the graph corresponds to the relevance value S ranging from 0 to 100. A straight line 50 is a depiction demonstrating that the PA is directly proportional to the S. Thus, given PA1<PA2, a relationship between S1 corresponding to PA1 and S2 corresponding to PA2 indicates that S1<S2. Such a proportional relationship demonstrates that a particular unit frame with a large PA frequently occurs in the speech data 120, and is thus relevant to emotion recognition. However, a unit frame that too often occurs within the speech data 120 may be neutral noise information. Hence, it may be difficult to select key frames that completely remove neutral noise information by only using PA alone.

Figure 6:
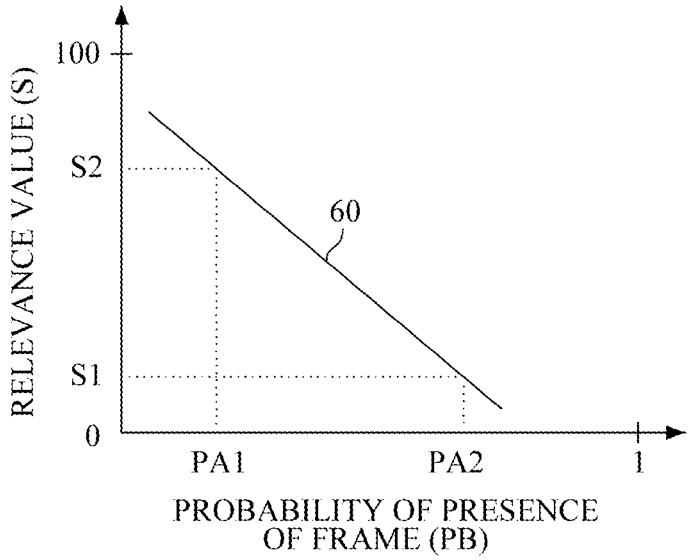
FIG. 6 is a graph illustrating a method of determining relevance of the particular unit frame for emotion recognition according to its probability of presence within reference data in the example illustrated in FIG. 4.

FIG. 6 is a graph illustrating a method of determining relative importance of a particular unit frame according to probability of presence within reference data according to the example shown in FIG. 4.

Referring to FIG. 6, a horizontal axis represents the presence probability (PB) ranging from 0 to 1, and a vertical axis represents the corresponding relevance value S ranging from 0 to 100. A straight line 60 shows that the PB is inversely proportional to the S. Thus, given PB1<PB2, a relationship between S2 corresponding to PB1 and S1 corresponding to PB2 is S1<S2. Such an inverse proportional relationship shows that a particular unit frame with a large PB does not frequently appear in the reference data 140, and is thus less likely to be neutral noise information; rather, the particular unit frame is likely to contain relevant information used for emotion recognition. By taking into account both PA and PB, it is possible to remove neutral noise information from the input speech and efficiently select relevant frames for emotion recognition.

Referring back to FIG. 4, the frame relevance estimator 45 may determine a particular unit frame with a higher PA to have a higher first relevance value. In addition, the frame relevance estimator 45 may determine the particular unit frame with a higher PB to have a lower second relevance value. Then, the relevance of the particular unit frame may be determined as the average of the first relevance value and the second relevance value. In another example, the relevance of a particular unit frame for emotion recognition may be determined with the first relevance value and the second relevance value reflected in the ratio of 4 to 6. It will be anticipated that, in addition to the aforementioned illustrated examples, the process of estimating the relevance of a single unit frame by using two relevance values may vary according to the need.

Referring back to FIG. 4, the key frame selector 47 may make a determination that the particular unit frame is a key frame, based on the relevance values assigned for the individual unit frames. For example, the key frame selector 47 may arrange the relevance values in order from smallest to largest or vice versa, and determine the unit frames whose relevance values are top 10% as being key frames.

Referring back to FIG. 1, the key frame based emotion-probability calculator 17 is a component to calculate a probability of an emotion represented by each key frame. The key frame based emotion-probability calculator 17 may use one of well-known techniques.

In one technique, the emotion-probability calculator 17 may generate a new global feature using parameter vectors of m key frames within the key frame data 160. For example, the emotion-probability calculator 17 may generate a global feature, such as, an average, the maximum value, or the minimum value of the parameter vectors of m key frames. By using a sorter, such as a support vector machine, it may be possible to calculate a probability that the generated global feature is classified into a particular emotion category. The calculated probability may indicate a probability of the emotion in the speech of a speaker belonging to the particular emotion category, that is, an emotion probability. In another technique, the key-frame-based emotion-probability calculator 17 may use generative models, such as Gaussian Mixture Model (GMM) or a hidden Markov model (HMM), which are obtained from learning various individual emotion categories. That is, a probability of the emotion state of the speech of a speaker belonging to a particular emotion category may be calculated, wherein the particular emotion category corresponds to one of generative models that is identified as generating the same or similar parameter vectors to the parameter vectors of the m key frames.

The emotion determiner 19 is a component that determines the emotion in the speech of a speaker according to the calculated emotion probability from the key-frame-based emotion-probability calculator 17. For example, when the calculated emotion probability meets a criterion, such as being greater than 0.5, the emotion determiner 19 may determine that a particular emotion category corresponding to the calculated emotion probability is the emotion in the speech of a speaker.

Figure 7:
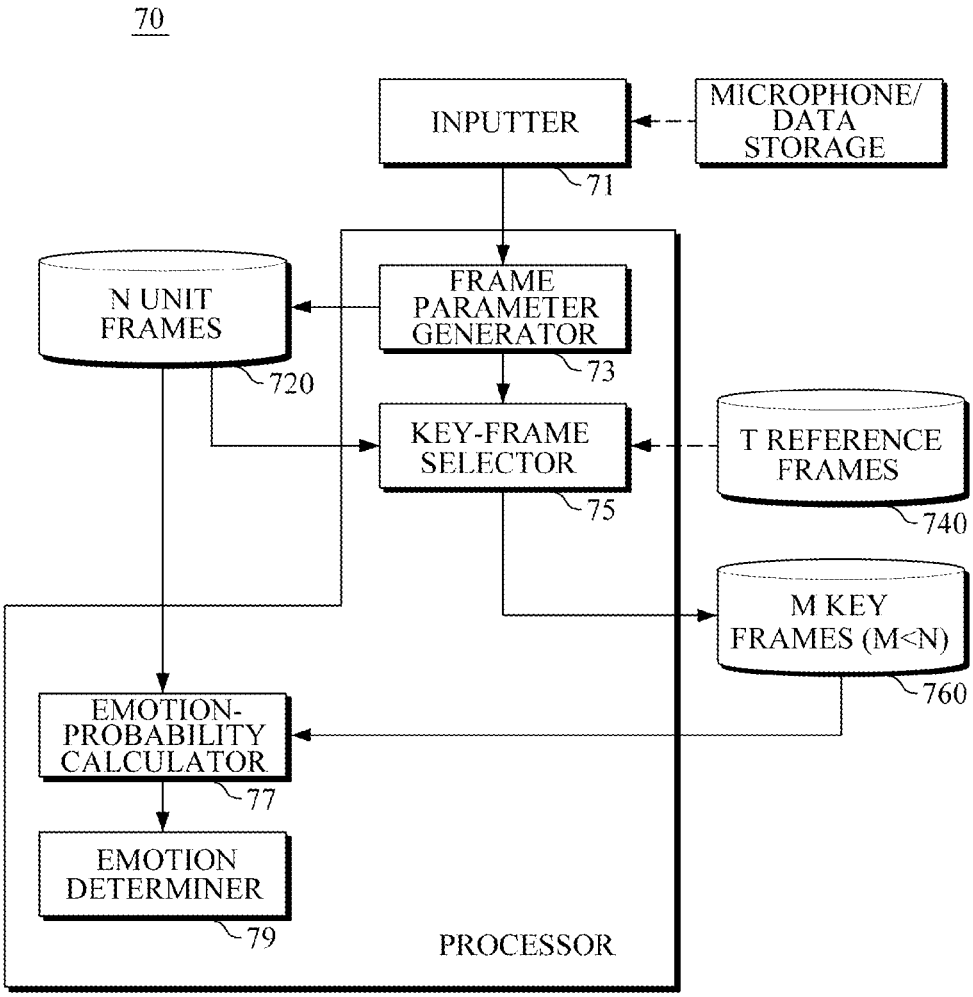
FIG. 7 is a block diagram illustrating another example of an apparatus for emotion recognition.

FIG. 7 is a block diagram illustrating another example of an apparatus for recognizing speech emotion.

Referring to FIG. 7, the apparatus 70 for recognizing speech emotion uses not only some frames selected from the speech of a speaker, but also all reference frames of the speech of a speaker.

The apparatus 70 may include a number of components including an inputter 71, a frame parameter generator 73, a key-frame selector 75, an emotion-probability calculator 77, and an emotion determiner 79.

The inputter 71, the frame parameter generator 73, the key-frame selector 75, and the emotion-probability calculator 77 may be similar to the inputter 11, the frame-parameter generator 13, the key-frame selector 15, and the emotion-probability calculator 17 of the apparatus 10 described with reference to FIGS. 1 to 6.

The apparatus 70 receives a speech of a speaker through the inputter 71. The frame-parameter generator 73 detects n unit frames from the speech of a speaker, and generates parameter vectors for the respective unit frames so as to generate speech data 720. The key-frame selector 75 may select some frames, i.e., m key frames from the speech data 720, to generate key frame data 760. The key-frame selector 75 may refer to reference data 740 that contains T reference frames. Then, the emotion-probability calculator 77 calculates the probability of an emotion in the speech of a speaker based on the key frames within the key frame data 760.

Here, the emotion-probability calculator 77 may calculate the emotion probability of the speech of a speaker based on the m key frames, and further calculate the emotion probability of the speech of a speaker using the n unit frames.

Similar to the emotion-probability calculator 17 of FIG. 1, the emotion-probability calculator 77 may calculate the emotion probability using one of two techniques. In one technique, the emotion-probability calculator 77 may generate a new global feature using the n unit frames within the speech data 720 or the parameter vectors of the m key frames. For example, the emotion-probability calculator 77 may generate a new global feature, such as an average, the maximum value, or the minimum value of the unit frames or the parameter vectors of the key frame. By utilizing a sorter, such as a SVM, it may be possible to calculate a probability that the generated global feature is classified into a particular emotion category. The calculated probability may indicate a probability of the emotion in the speech of a speaker belonging to the particular emotion category, that is, an emotion probability.

The emotion determiner 79 is a component that determines the emotion of the speech of a speaker by taking into consideration both emotion probabilities calculated by the emotion-probability calculator 77 with respect to the same emotion. For example, when the calculated emotion probability, which may be the average or a weighted average of the two emotion probabilities, meets a criterion, such as being greater than 0.5, the emotion determiner 19 may determine that an emotion corresponding to the calculated emotion probability is the emotion in the speech of a speaker.

Figure 8:
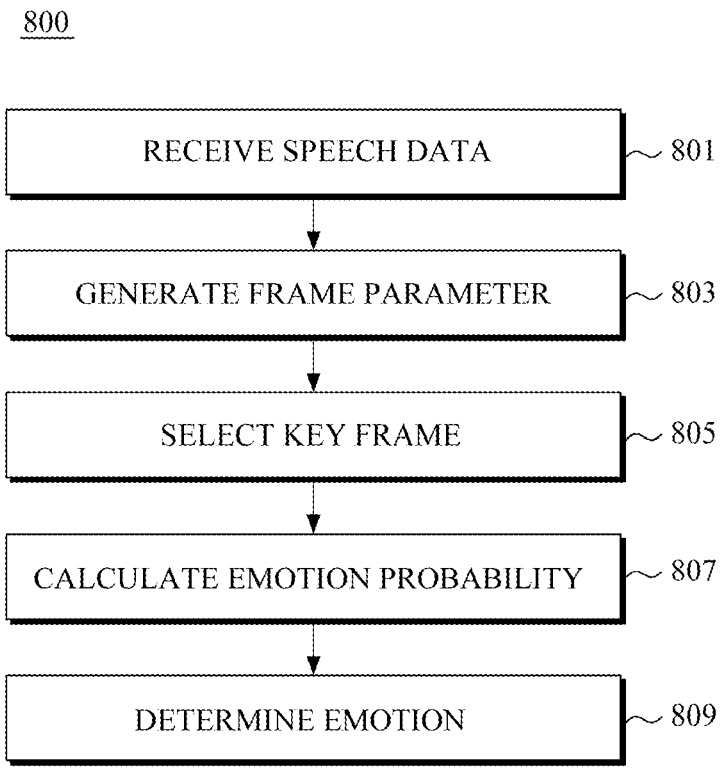
FIG. 8 is a flowchart illustrating an example of a method for emotion recognition.

FIG. 8 is a flowchart illustrating an example of a method for recognizing voice emotion.

Referring to FIG. 8, the method 800 may start with receiving a speech of a speaker in 801.

N unit frames may be detected from the received speech of a speaker. The unit frames are voice data frames that are presumed to contain meaningful information. Such a frame detection method is well known in the field of speech emotion recognition. In 803, parameter vectors are generated from the respective detected unit frames. The parameter vectors may include information contained in the corresponding frames or parameters, such as spectrum, MFCC, formant, etc., which are computable from the information.

Then, key frames are selected from among the unit frames in 805. Operation 805 will be further described with reference to FIG. 9.

Figure 9:
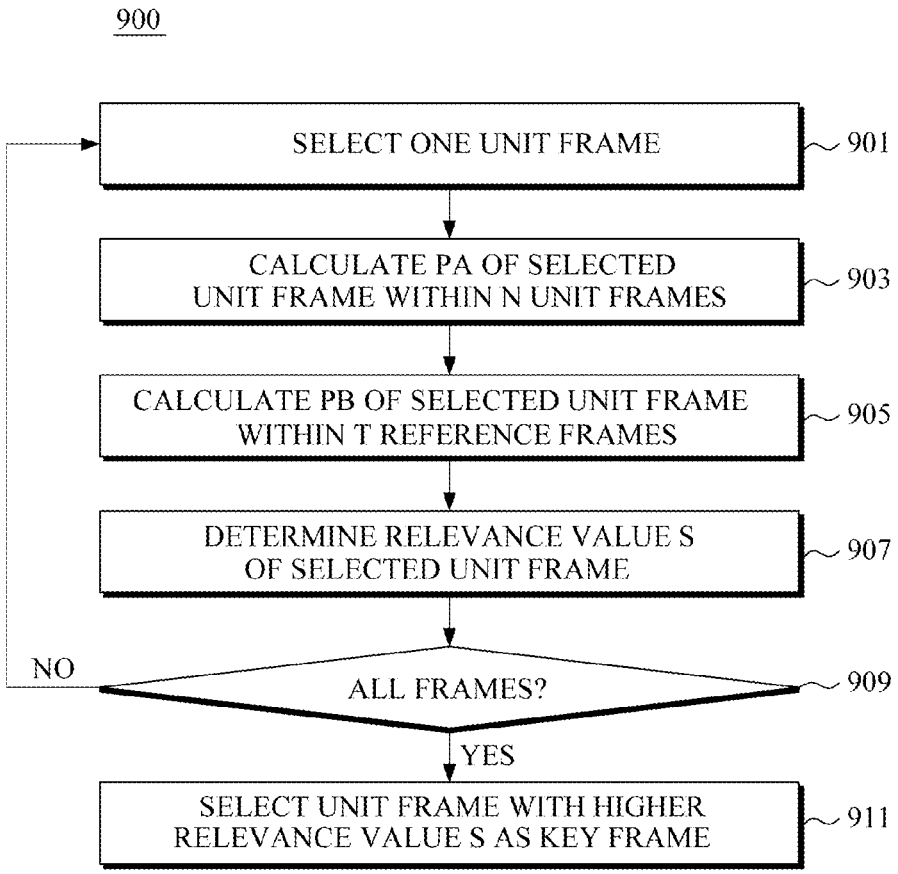
FIG. 9 is a flowchart illustrating an example of the process of selecting key frames according to FIG. 8.

FIG. 9 is a flowchart illustrating an example of the process of selecting key frames of FIG. 8.

Referring to FIG. 9, in 901, one of unit frames is selected.

In 903, the probability (PA) of occurrence of the selected unit frame within the unit frames is calculated. Each unit frame has a parameter vector, and the unit frames with the same or similar parameter vectors may be counted as the same unit frames. Thus, the number of unit frames that are the same as the selected unit frame among n unit frames may be determined as the PA of the selected unit frame.

In 905, the probability (PB) of presence of the selected unit frame within reference frames is calculated. The reference frames have already been through the voice recognition process. Thus, the reference frames with the same or similar parameter vectors to the parameter vector of the selected unit frame may be counted as the same reference frames as the selected unit frame. Thus, the same number of reference frames as the selected unit frame from among t reference frames may be determined as the PB.

In 907, the relevance value S of the selected unit frame may be determined based on the calculated PA and PB. In this case, the unit frame with a higher PA is assigned a higher first relevance value with which the unit frame is more likely to be selected as a key frame. Conversely, the same unit frame with a higher PB is assigned a lower second relevance value with which the unit frame is less likely to be selected as a key frame. In addition, the relevance of the unit frame may be estimated by taking into consideration both the first relevance value and the second relevance value. The estimated relevance value S is a relative value, which may be determined in comparison to relevance values of the other unit frames.

In 909, a determination is made as to whether or not operations 903 to 907, in which probability computation and relevance value has been determined, have been completed for every n unit frame detected from the speech of a speaker. In response to a determination that the operations 903 to 907 have not been completed ("NO" in operation 909), operations 901 to 907, in which another unit frame is selected and probabilities associated with the selected unit frame are calculated, are performed.

In response to a determination that all n unit frames detected from the speech of a speaker have been completely through the probability computation and relevance value determination (operations 903 to 907) ("YES" in operation 909), the flow proceeds to operation 911. In 911, the unit frames are arranged according to the order of their relevance values. Then, a key frame may be selected according to a predetermined criterion, such as, top 10% relevance values.

Referring back to FIG. 8, after operation 805, which may be the process 900 shown in FIG. 9, an emotion probability is calculated in 807. The emotion-probability computation may be performed only on the selected key frames, using a sorter, such as an SVM, and a global feature or, using generative models, such as Gaussian mixture models (GMM) or hidden Markov models (HMM), which are obtained from learning emotion categories.

Lastly, in 809, the emotion in the speech of a speaker may be determined according to the calculated emotion probability. For example, when the calculated emotion probability meets a criterion, such as being greater than 0.5, an emotion corresponding to the probability is determined as the emotion in the speech of a speaker.

Figure 10:
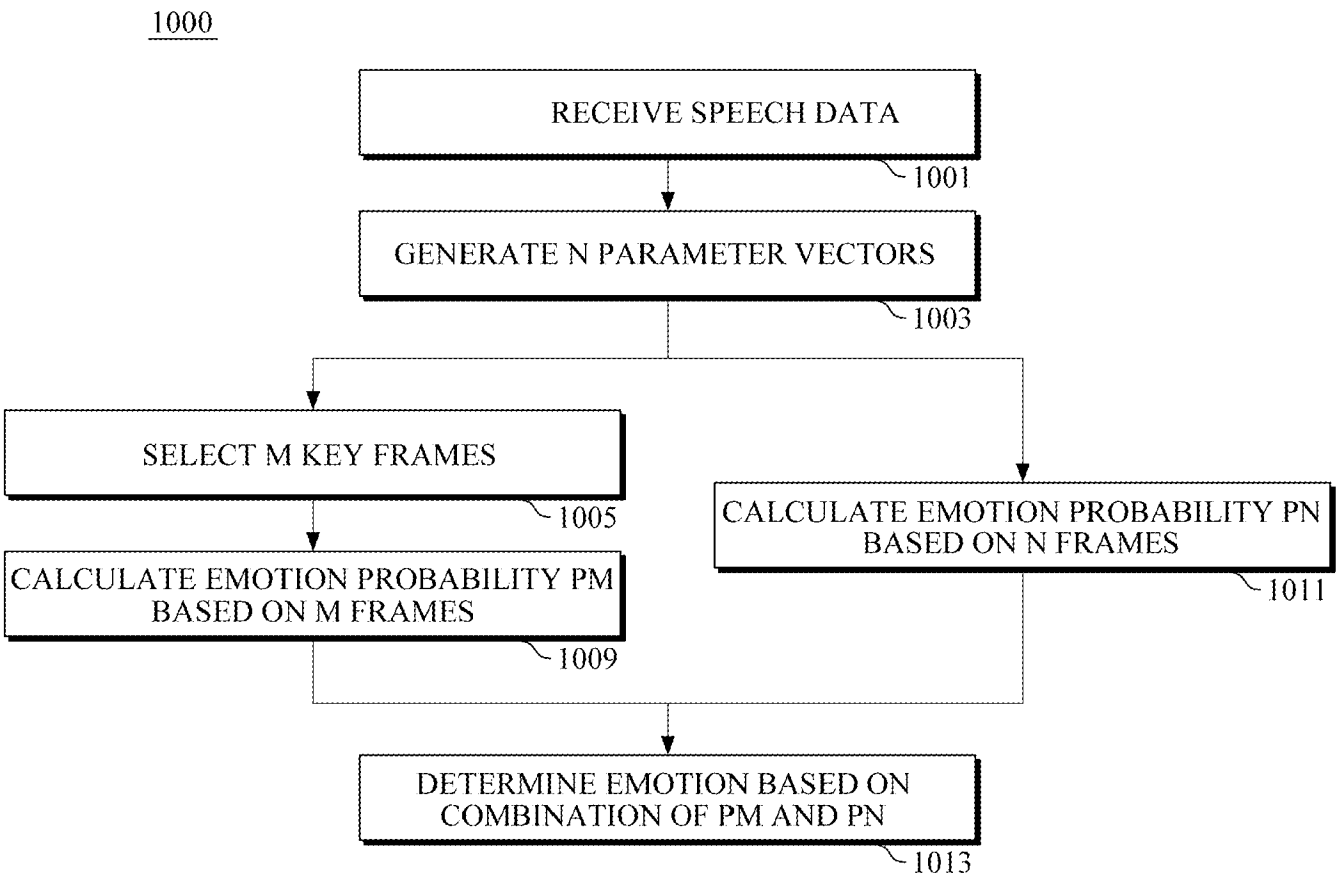
FIG. 10 is a flowchart illustrating another example of a method for recognizing emotion of a speaker.

FIG. 10 is a flowchart illustrating another example of a method for emotion recognition based on speech.

Referring to FIG. 10, the method 1000 involves recognizing an emotion of a speaker by taking into account both the speech of the speaker and key frames selected from the speech of the speaker.

In 1001, a speech of a speaker from which the emotion of the speaker is to be recognized is received. For example, the speech may be received in the form of voice data obtained either from a microphone or a computer readable storage medium that stores voice data. In 1003, n unit frames are detected from the speech of a speaker, and parameter vectors are generated from the respective unit frames. The determination of the n unit frames and the generation of the parameter vectors may be performed by one or more computer processor. Then, in 1005, m key frames are selected from n unit frames. In 1009, the emotion probability (PM) of the speech of a speaker is calculated based on the selected m key frames.

After operation 1003 in which the n unit frames and the parameter vectors are generated, an emotion probability (PN) of the speech of a speaker is calculated based on the n unit frames, and this calculation is performed separately from the selection of key frames and calculation of the PN based on the selected key frames.

In 1013, the emotion in the speech of a speaker is determined by taking into account both the emotion probability (PM) calculated based on the selected m key frames and the emotion probability (PN) calculated based on n unit frames, or based on the combination of the PM and the PN.

The components of the apparatus for recognizing speech emotion described above may be implemented as hardware that includes circuits to execute particular functions. Alternatively, the components of the apparatus described herein may be implemented by the combination of hardware, firmware and software components of a computing device. A computing device may include a processor, a memory, a user input device, and/or a presentation device. A memory may be a computer readable medium that stores computer-executable software, applications, program modules, routines, instructions, and/or data, which are coded to perform a particular task in response to being executed by a processor. The processor may read and execute or perform computer-executable software, applications, program modules, routines, instructions, and/or data, which are stored in the memory. The user input device may be a device capable of enabling a user to input an instruction to cause a processor to perform a particular task or to input data required to perform a particular task. The user input device may include a physical or virtual keyboard, a keypad, a mouse, a joystick, a trackball, a touch-sensitive input device, microphone, etc. The presentation device may include a display, a printer, a speaker, a vibration device, etc.

In addition, the method, procedures, and processes for recognizing a speech emotion described herein may be implemented using hardware that includes a circuit to execute a particular function. Alternatively, the method for recognizing a speech emotion may be implemented by being coded into computer-executable instructions to be executed by a processor of a computing device. The computer-executable instruction may include software, applications, modules, procedures, plugins, programs, instructions, and/or data structures. The computer-executable instructions may be included in computer-readable media. The computer-readable media may include computer-readable storage media and computer-readable communication media. The computer-readable storage media may include as read-only memory (ROM), random access memory (RAM), flash memory, optical disk, magnetic disk, magnetic tape, hard disk, solid state disk, etc. The computer-readable communication media may refer to signals capable of being transmitted and received through a communication network that are obtained by coding computer-executable instructions having a speech emotion recognition method coded thereto.

The computing device may include various devices, such as wearable computing devices, hand-held computing devices, smartphones, tablet computers, laptop computers, desktop computers, personal computers, servers, and the like. The computing device may be a stand-alone type device. The computing device may include multiple computing devices that cooperate through a communication network.

The apparatus described with reference to FIGS. 1 to 7 is only exemplary. It will be apparent to one of ordinary skill in the art that various other combinations and modifications may be possible without departing from the spirit and scope of the claims and their equivalent. The components of the apparatus may be implemented using hardware that includes circuits to implement individual functions. In addition, the components may be implemented by the combination of computer-executable software, firmware, and hardware, which is enabled to perform particular tasks in response to being executed by a processor of the computing device.

The method described above with reference to FIGS. 8 to 10 is only exemplary. It will be apparent to one skilled in the art that various other combinations of methods may be possible without departing from the spirit and scope of the claims and their equivalent. Examples of the method for recognizing a speech emotion may be coded into computer-executable instructions that cause a processor of a computing device to perform a particular task. The computer-executable instructions may be coded using a programming language, such as Basic, FORTRAN, C, C++, etc. by a software developer and then compiled into a machine language.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An apparatus for emotion recognition, the apparatus comprising a processor that comprises:

a frame parameter generator configured to detect a plurality of unit frames from an input speech and to generate a parameter vector for each of the unit frames;

a key-frame selector configured to select a unit frame as a key frame among the plurality of unit frames;

an emotion-probability calculator configured to calculate an emotion probability of the selected key frame; and an emotion determiner configured to determine an emotion of a speaker based on the calculated emotion probability, wherein the key-frame selector is configured to select a unit frame with a lower probability of presence than a predetermined fraction of the plurality of unit frames as the key frame, and wherein the emotion-probability calculator is configured to calculate the emotion probability by extracting a global feature from the selected key frame and classifying an emotion of the speaker into at least one of predefined emotion categories using a support vector machine (SVM) mechanism and the global feature, or by classifying an emotion of the speaker into at least one emotion category that corresponds to a generative model that is capable of generating a largest number of parameter vectors same as or similar to those of the key frames, wherein the generative model is one of Gaussian Mixture Model (GMM) and Hidden Markov Model (HMM), which are obtained from learning each emotion category.

2. The apparatus of claim 1, wherein the key-frame selector is configured to select the key frame according to a probability of occurrence within the plurality of unit frames, wherein the probability of occurrence indicates a number of unit frames among the plurality of unit frames having a similar parameter vector to a key parameter vector of the key frame.

3. The apparatus of claim 2, wherein the key-frame selector is configured to select a unit frame with a higher probability of occurrence than a predetermined fraction of the plurality of unit frames as the key frame.

4. The apparatus of claim 1, wherein the key-frame selector is configured to select the key frame according to a probability of presence within a plurality of previously stored reference frames, wherein the probability of presence indicates a number of the reference frames having a similar parameter vector to a key parameter vector of the key frame.

5. The apparatus of claim 1, wherein the key-frame selector is configured to comprise:

an occurrence probability calculator configured to calculate an occurrence probability of each unit frame occurring within the plurality of unit frames;

a presence probability calculator configured to calculate a presence probability of each unit frame being present within a plurality of previously stored reference frames;

a frame relevance estimator configured to assign a first relevance value to each unit frame with a higher occurrence probability, assign a second relevance value to the each unit frame with a higher presence probability, wherein the first relevance value indicates a higher probability of being selected as a key frame, and the second relevance value indicates a lower probability of being selected as a key frame, and to estimate relevance of each unit frame by taking into consideration both the first relevance value and the second relevance value; and a key-frame determiner configured to determine the unit frame as being the key frame according to the assigned first and second relevance values.

6. The apparatus of claim 1, wherein the emotion-probability calculator is configured to further calculate a respective emotion probability of each of the unit frames, and the emotion determiner is configured to determine an emotion of the speaker using both the emotion probability of the key frame and the calculated respective emotion probabilities of the unit frames.

7. The apparatus of claim 6, wherein the emotion-probability calculator is further configured to calculate the respective emotion probability of each of the unit frames by extracting a respective global feature from the each unit frame and classifying the emotion of the speaker into at least one of the predefined emotion categories using the SVM and the extracted respective global features, or by classifying the emotion of the speaker into at least one emotion category that corresponds to a generative model that is capable of generating a largest number of parameter vectors same as or similar to those of the unit frames, wherein the generative model is one of Gaussian Mixture Model (GMM) and Hidden Markov Model (HMM), which are obtained from learning each emotion category.

8. The apparatus of claim 1, wherein the key-frame selector is further configured to select additional key frames from among the plurality of unit frames;

the emotion-probability calculator is further configured to calculate an additional emotion probability of each of the selected additional key frames; and the emotion determiner is further configured to determine the emotion of the speaker based on the calculated emotion probability and the additional emotion probabilities.

9. The apparatus of claim 1, wherein the emotion-probability calculator is further configured to calculate the emotion probability of the selected key frame while excluding remaining unit frames of the plurality of unit frames that are not selected as the key frame.

10. A method for emotion recognition, the method comprising:

detecting a plurality of unit frames from an input speech and generating a parameter vector for each of the unit frames;

selecting a unit frame as a key frame among the plurality of unit frames;

calculating an emotion probability for the selected key frame; and using a processor to determine an emotion of a speaker based on the calculated emotion probability, wherein the selecting of the key frame comprises selecting a unit frame with a lower probability of presence than a predetermined fraction of the plurality of unit frames as the key frame, and wherein the calculating of the emotion probability comprises extracting a global feature from the selected key frames and classifying an emotion of the speaker into at least one of predefined emotion categories using a support vector machine (SVM) mechanism and the global feature, or by classifying an emotion of the speaker into at least one emotion category that corresponds to a generative model that is capable of generating a largest number of parameter vectors same as or similar to those of the key frames, wherein the generative model is one of Gaussian Mixture Model (GMM) and Hidden Markov Model (HMM), which are obtained from learning each emotion category.

11. The method of claim 10, wherein the selecting of the key frame comprises selecting the key frame according to probability of occurrence within the plurality of unit frames.

12. The method of claim 11, wherein the selecting of the key frame comprises selecting a unit frame with a higher probability of occurrence than a predetermined fraction of the plurality of unit frames as the key frame.

13. The method of claim 10, wherein the selecting of the key frame comprises selecting the key frame according to probability of presence within a plurality of previously stored reference frames.

14. The method of claim 10, wherein the selecting of the key frame comprises:

calculating an occurrence probability of each unit frame occurring within the plurality of unit frames;

calculating a presence probability of each unit frame present within a plurality of previously stored reference frames;

assigning a first relevance value to each unit frame with a higher occurrence probability, and assigning a second relevance value to the each unit frame with a higher presence probability, wherein the first relevance value indicates a higher probability of being selected as a key frame and the second relevance value indicates a lower probability of being selected as a key frame, and estimating relevance of each unit frame by taking into consideration both the first relevance value and the second relevance value; and determining the unit frame as the key frame according to the assigned first and second relevance values.

15. The method of claim 10, wherein the calculating of the emotion probability comprises further calculating a respective emotion probability of each of the unit frames, and determining the emotion of the speaker using both the emotion probability of the key frame and the calculated respective emotion probabilities of the unit frames.

16. The method of claim 15, wherein the calculating of the respective emotion probability of each of the unit frames comprises:

extracting a respective global feature from each unit frame and classifying the emotion of the speaker into at least one of the predefined emotion categories using the SVM and the extracted respective global features; or classifying the emotion of the speaker into at least one emotion category that corresponds to a generative model that is capable of generating a largest number of parameter vectors same as or similar to those of the unit frames, wherein the generative model is one of Gaussian Mixture Model (GMM) and Hidden Markov Model (HMM), which are obtained from learning each emotion category.

17. An apparatus for emotion recognition, comprising:

a microphone configured to detect an input speech; and a processor configured to divide the input speech into a plurality of unit frames, to select a unit frame as a key frame among the plurality of unit frames based on relevance of each of the unit frames for emotion recognition, to calculate an emotion probability of the selected key frame, to determine an emotion of the speaker based on the calculated emotion probability, to select a unit frame with a lower probability of presence than a predetermined fraction of the plurality of unit frames as the key frame, and to calculate the emotion probability by extracting a global feature from the selected key frame and classifying an emotion of the speaker into at least one of predefined emotion categories using a support vector machine (SVM) mechanism and the global feature, or by classifying an emotion of the speaker into at least one emotion category that corresponds to a generative model that is capable of generating a largest number of parameter vectors same as or similar to those of the key frames, wherein the generative model is one of Gaussian Mixture Model (GMM) and Hidden Markov Model (HMM), which are obtained from learning each emotion category.

18. The apparatus of claim 17, wherein the processor is configured to select a unit frame with a higher probability of occurrence than a predetermined fraction of the plurality of unit frames as the key frame.

* * * * *